US008664628B2

(12) United States Patent
Yoder

(10) Patent No.: US 8,664,628 B2
(45) Date of Patent: Mar. 4, 2014

(54) RADIATION BARRIER PANEL

(75) Inventor: Steven M. Yoder, Lake Ozark, MO (US)

(73) Assignee: Performance Contracting, Inc., Lenexa, KS (US)

( * ) Notice: Subject to any disclaimer, the term of this patent is extended or adjusted under 35 U.S.C. 154(b) by 43 days.

(21) Appl. No.: 13/590,366

(22) Filed: Aug. 21, 2012

(65) Prior Publication Data

US 2013/0048887 A1 Feb. 28, 2013

Related U.S. Application Data

(60) Provisional application No. 61/525,973, filed on Aug. 22, 2011.

(51) Int. Cl.
*G21F 1/12* (2006.01)

(52) U.S. Cl.
USPC ..... 250/515.1; 250/516.1

(58) Field of Classification Search
USPC ..... 250/515.1
See application file for complete search history.

(56) References Cited

U.S. PATENT DOCUMENTS 4,530,813 A 7/1985 Jacobson
4,608,495 A 8/1986 Jacobson
4,647,714 A * 3/1987 Goto ..... 174/36
4,833,335 A 5/1989 McGinley et al.
6,674,087 B2 * 1/2004 Cadwalader et al. ..... 250/515.1
6,871,379 B2 3/2005 Ebeling et al.
7,476,889 B2 * 1/2009 DeMeo et al. ..... 250/516.1
7,511,292 B2 3/2009 Baudro
7,540,509 B1 6/2009 Boraas et al.
7,897,949 B2 * 3/2011 Ballsieper ..... 250/515.1
2002/0174512 A1 11/2002 Sorensen
2007/0277350 A1 12/2007 Hines

OTHER PUBLICATIONS

SILFLEX Lightweight, Non-Lead Shielding Blankets—MarShield custome radiation protection, shielding and storage (2 page brochure).
Structural Insulated Panels (SIPS) including steel-faced SIPS—Technical Specification Sheet (4 pages) and Product Information (2 pages)—Precision Foam Fabricators—Product on sale and materials published prior to Aug. 22, 2010.

* cited by examiner

*Primary Examiner* — Phillip A Johnston
(74) *Attorney, Agent, or Firm* — Womble Carlyle Sandridge & Rice LLP

(57) ABSTRACT

A panel for functioning as a barrier to radiation includes at least one layer for restricting the passage of radiation, and the layer for restricting the passage of radiation may be a layer of silicone impregnated with metal, such as tungsten and/or iron. The impregnated silicone layer may be mounted to and supported by at least one other structure of the panel. For example, the impregnated silicone layer may be positioned between, and laminated to, other layers of the panel. In one embodiment, the impregnated silicone layer is positioned between foam layers of the panel to form a core, and the core is positioned between exterior layers of the panel. One or more exterior layers of the panel may be in the form of sheet metal or any other suitable structure.

8 Claims, 5 Drawing Sheets

RADIATION BARRIER PANEL

CROSS-REFERENCE TO RELATED APPLICATION

This application claims the benefit of U.S. Provisional Patent Application No. 61/525,973, which was filed Aug. 22, 2011.

INCORPORATION BY REFERENCE

The entire disclosure of U.S. Provisional Patent Application No. 61/525,973, which was filed Aug. 22, 2011, is incorporated herein by reference.

FIELD OF THE DISCLOSURE

This disclosure relates to shields for inhibiting the propagation of radiation and, more specifically, to panels that may be used for inhibiting the propagation of alpha, beta and/or gamma radiation.

BACKGROUND

At nuclear power plants and some other types of facilities, provisions are made to protect people from propagating radiation, such as alpha, beta and/or gamma radiation. Whereas this disclosure primarily refers to protecting people from the propagating radiation, it should be understood throughout this disclosure that it may be desirable to protect other objects, such as certain types of equipment, from radiation.

It is known to protect one or more people from propagating radiation by positioning one or more shields between the source of the radiation and people. Examples of known shields include portable panels formed by encasing lead in a steel shell, flexible blankets comprising silicone impregnated with tungsten, and flexible blankets comprising lead. Notwithstanding, there is a desire for radiation shields that provide a new balance of properties.

BRIEF SUMMARY

One aspect if this disclosure is the provision of a panel for functioning as a barrier to radiation, wherein the panel includes at least one layer for restricting the passage of radiation, and the layer for restricting the passage of radiation may be, but is not limited to, a layer of silicone impregnated with metal (e.g., tungsten and/or iron). The impregnated silicone layer may be mounted to and supported by at least one other structure of the panel. For example, the impregnated silicone layer may be positioned between, and laminated to, other layers of the panel. In one embodiment, the impregnated silicone layer is positioned between foam layers of the panel to form a core, and the core is positioned between exterior layers of the panel. One or more of the exterior layers of the panel may be in the form of sheet metal, such as a sheet of steel, or any other suitable structure. In one example, for each side of the panel, the foam and steel may be together characterized as a composite that substantially provides strength to the panel, whereas the silicone impregnated with metal substantially provides the radiation attention of the panel.

One or more of the layers of the panel may be secured together with adhesive material interposed therebetween and/or the panel may be held together by at least one channel member. In one example, each of the layers of the panel extend to top, bottom, and side edges of the panel, grooves of generally C or U-shaped shaped channel members are respectively in receipt of the edges of the panel, and the channel members are respectively joined end-to-end with one another so that the panel is enclosed in a frame. The frame may be characterized as being part of the panel. The channel members of the frame may be lengths of metal, or they may be formed by durable, strong tape or any other suitable structure. In an alternative embodiment, one or more layers of the panel may be secured together with mechanical fasteners such as, but not limited to, clips, screws, nuts and bolts, or any other suitable fasteners.

In one embodiment, each of the panels, with or without a frame, is strong enough to support at least its own weight without deforming substantially, and may be referred to as a structural insulated panel. The panels may be installed permanently, or they may be portable and be repeatably moved do different locations. For example, the panels may be equipped with one or more features, such as handles for being gripped, eyelets for lifting, wheels for rolling, and/or any other suitable features.

In accordance with one aspect of this disclosure, a panel for attenuating radiation may include a layered structure comprising a laminate secured between layers of metal, wherein the laminate may comprise a flexible layer comprising polymeric material and metal for attenuating radiation, and a layer of foam secured to the layer of silicone containing metal, wherein the flexible layer is more flexible than the layer of foam.

In accordance with another aspect of this disclosure, a panel for attenuating radiation, may include a layered structure having a plurality of layers that are secured together, wherein the plurality of layers may include a layer comprising polymeric material and metal for attenuating radiation, a layer of foam, and an exterior layer, wherein the exterior layer is harder than each of the layer of foam and the layer of silicone containing metal, and an exterior surface of the exterior layer is substantially nonporous.

According to another aspect of this disclosure, a panel for attenuating radiation includes a layered structure and a channel member. The layered structure comprises a first exterior layer at least partially defining a first side of the panel, a second exterior layer at least partially defining a second side of the panel, wherein the second side of the panel is opposite the first side of the panel, and an interior layer comprising polymeric material and metal, wherein the metal is for attenuating radiation, and the interior layer is positioned between the first and second exterior layers. A compound edge of the layered structure comprises an edge of the first exterior layer and an edge of the second exterior layer. The channel member is mounted to the compound edge of the layered structure. The channel member defines a groove, and the groove is in receipt of the compound edge of the layered structure, so that the groove is in receipt of both the edge of the first exterior layer and the edge of the second exterior layer.

The foregoing presents a simplified summary of some aspects of this disclosure in order to provide a basic understanding. The foregoing summary is not an extensive summary of the disclosure and is not intended to identify key or critical elements of the invention or to delineate the scope of the invention. The purpose of the foregoing summary is to present some concepts of this disclosure in a simplified form as a prelude to the more detailed description that is presented later. For example, other aspects of this disclosure will become apparent from the following.

BRIEF DESCRIPTION OF THE DRAWINGS

Having described some aspects of this disclosure in general terms, reference will now be made to the accompanying drawings, which are schematic and not necessarily drawn to scale. The drawings are exemplary only, and should not be construed as limiting the invention.

FIG. 1 is also representative of a rear pictorial view of the panel, in accordance with a first embodiment of this disclosure.

DETAILED DESCRIPTION

Exemplary embodiments of this disclosure are described below and selected features are illustrated in the accompanying figures, in which like numerals refer to like parts throughout the several views. The following description provides examples and should not be interpreted as limiting the scope of the invention.

Figure 1:
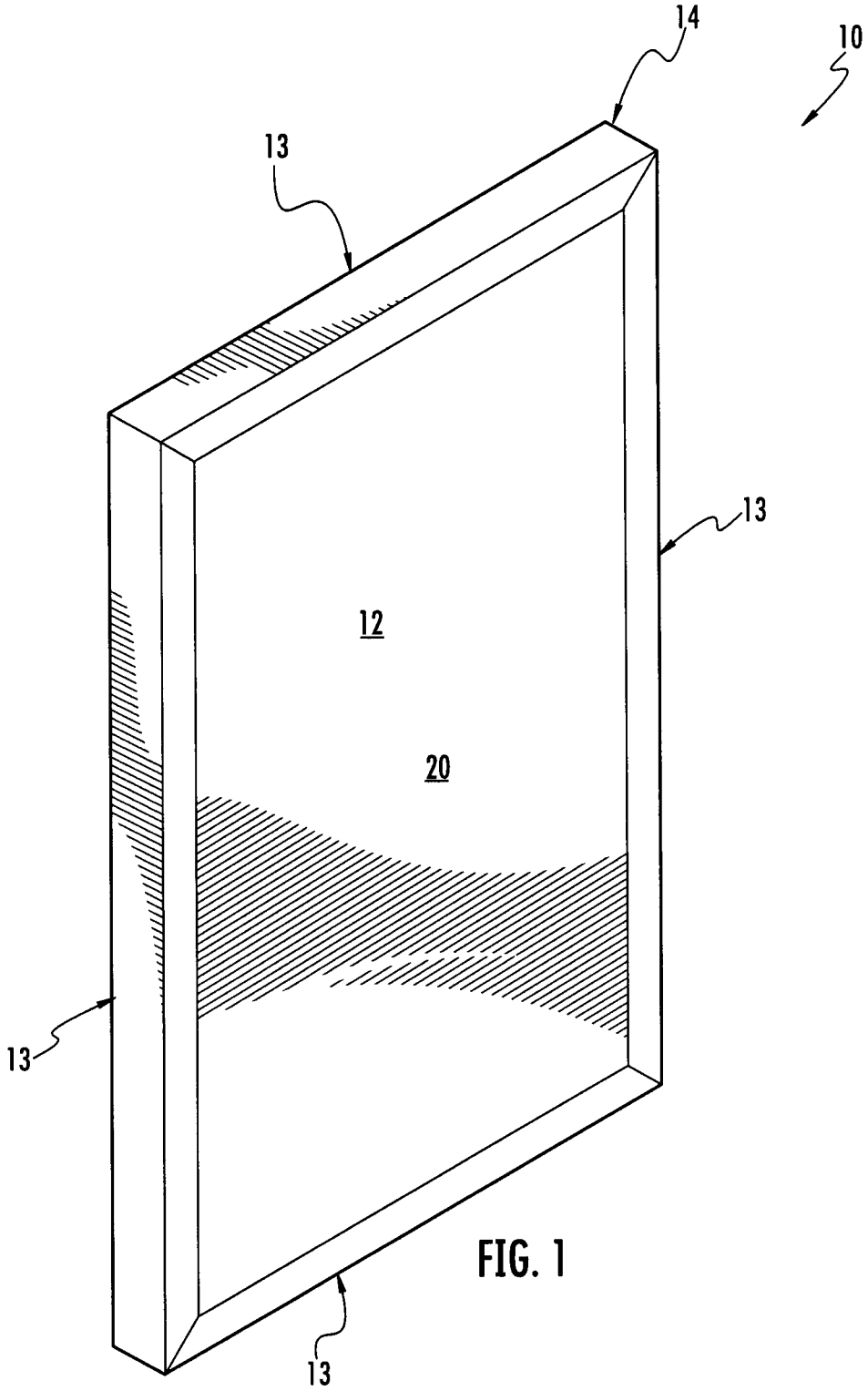
FIG. 1 is a front pictorial view of a panel that may be used as a radiation barrier and/or structural panel.
Figure 2:
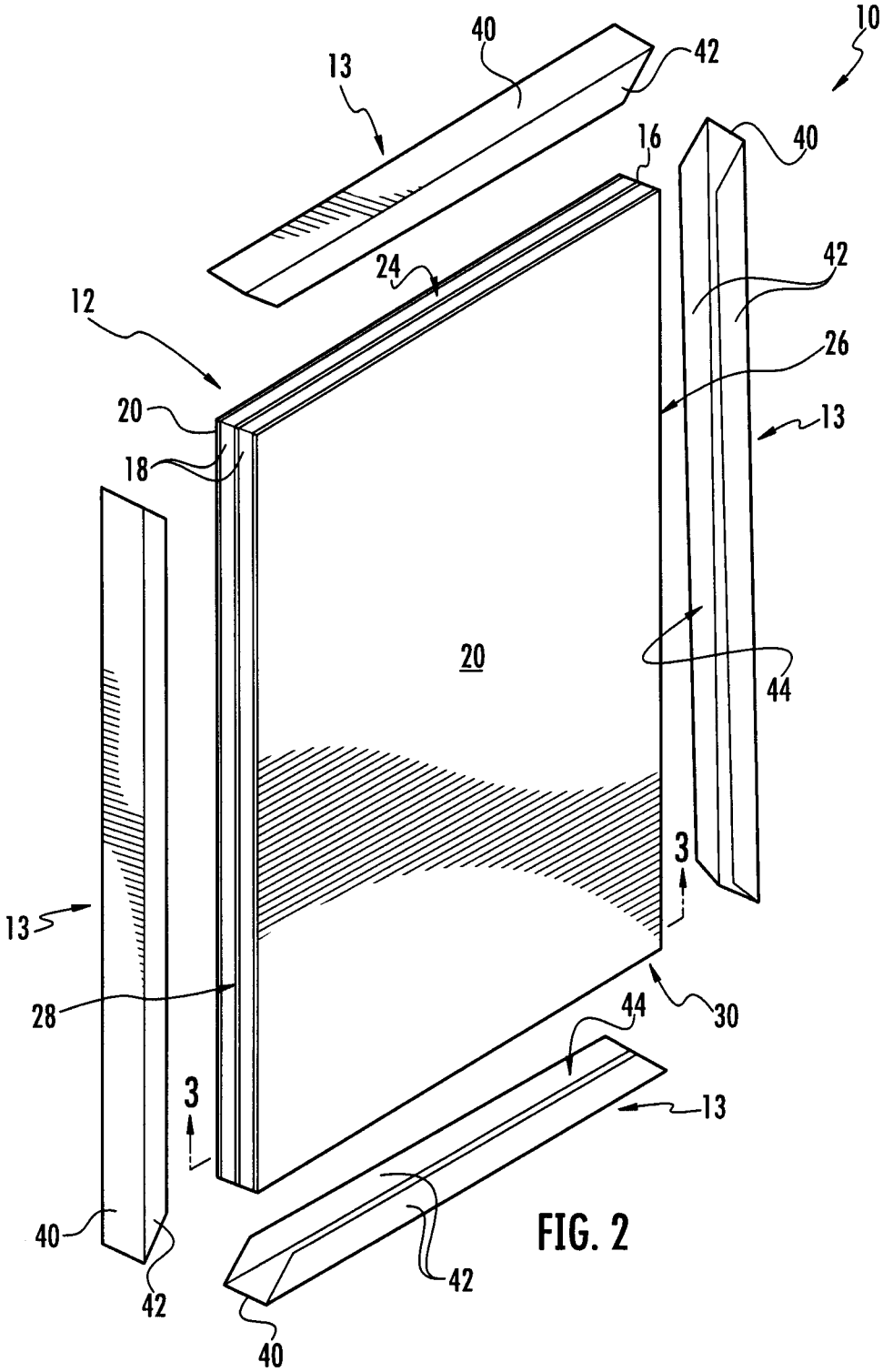
FIG. 2 is like FIG. 1, except for showing edge covers or frame members exploded away from edges of a layered structure of the panel.

A panel 10 of a first embodiment of this disclosure is described in the following with reference to FIGS. 1-5. The panel 10 may be used, for example, as a barrier to radiation, and it may also be used as a structural panel or a structural insulated panel. Referring to FIGS. 1 and 2, the panel 10 includes a layered structure 12 and one or more edge covers 13 for at least partially covering one or more edges of the layered structure. The edge covers 13 may cooperatively form a frame 14 that extends at least partially around, or more specifically extends all the way around and encloses, the layered structure 12, as will be discussed in greater detail below.

Figure 3:
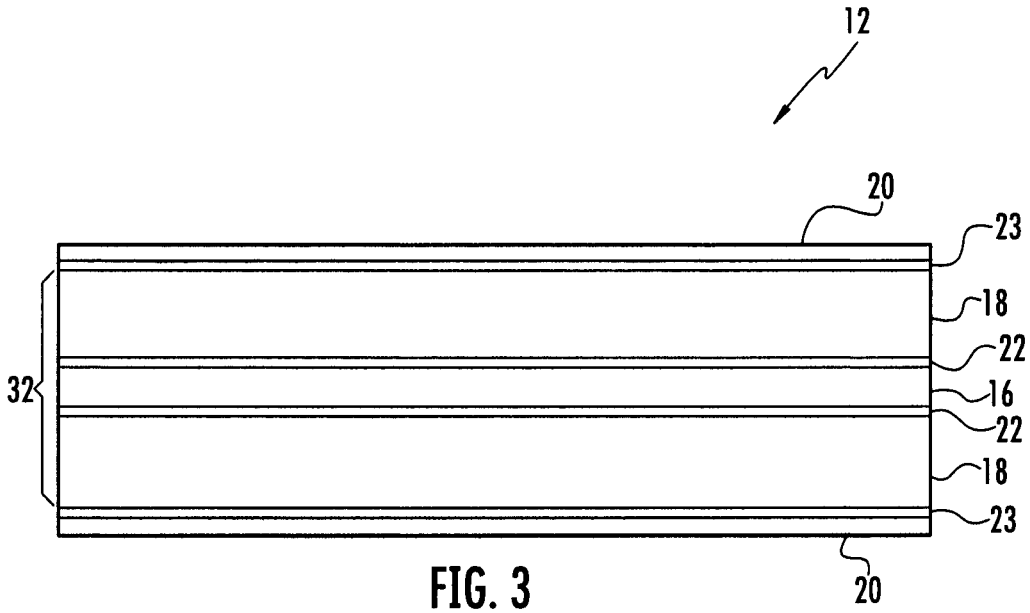
FIG. 3 is an isolated, cross-sectional view of a representative portion of the layered structure, with the cross-section taken along line 3-3 of FIG. 2.

Referring to FIGS. 2 and 3, the layered structure 12 includes in interior layer 16 positioned between exterior layers 20, and the layered structure may optionally further include intermediate layers 18 respectively positioned between the interior and exterior layers. The layers 16, 18, 20 of the layered structure 12 may be secured together by the edge cover(s) 13, frame 14 and/or one or more bonding layers 22, 23 (FIG. 3). Any suitable adhesive materials may be used for the bonding layers 22, 23, and one or more of the bonding layers may be omitted. The adhesive materials and other components of the panel 10 will typically be selected to be durable in the environments in which the panel may be used. For example, the components of the panel 10 may be selected so that panel will perform satisfactorily for an extended period of time as a barrier to radiation, a structural panel and/or a structural insulated panel. As a specific example, when the panel 10 is to be used as a barrier to radiation, the components selected for use in the panel will typically be those types of components that will not degrade, or not degrade too much, when exposed to radiation for an extended period of time. More generally, the components of the panel 10 may be tailored to the intended usage of the panel. For example, the exterior layers 20 and frame 14 may be made of metal, such as steel, or stainless steel, for purposes of cleanliness and durability.

In accordance with the first embodiment, the interior layer 16 is operative for functioning as a barrier to radiation, such as by attenuating propagating radiation (e.g., alpha, beta and gamma radiation). Whereas the interior layer 16 may be any suitable material, the interior layer of the first embodiment is a flexible layer comprising polymeric material and metal, wherein the metal is for attenuating radiation. More specifically, the polymeric material comprises silicone and the metal comprises tungsten and/or iron, and the silicone at least partially contains the tungsten and/or iron. Even more specifically, the tungsten and/or iron may be impregnated in the silicone. Even more specifically, the flexible interior layer may consist essentially of silicone impregnated with tungsten and/or iron. The silicone may also or alternatively be impregnated with any other suitable materials. For example, the interior layer 16 may be a flexible layer of Silflex brand radiation shielding material available from, for example, MarShield (Mars Metal Company division of Marswell Metal Industries Ltd.) or American Ceramic Technology, Inc. Alternatively, the interior layer may comprise any other suitable material(s) for attenuating radiation. That is, this disclosure is not limited to the Silflex brand radiation shielding material available from MarShield or American Ceramic Technology, Inc. For example, any suitable source for the interior layer 16 may be used.

As will be discussed in greater detail below, the interior layer 16 may be mounted to each of the intermediate layers 18 so that the intermediate layers at least partially support the interior layer and/or the combination of the intermediate and exterior layers 18, 20 support the interior layer, and the exterior layers 20 may form a protective cover or shield of the layered structure 12/panel 10. Referring to FIG. 3 and as a more specific example, the interior layer 16 may be a 0.5 inch thick layer of silicone impregnated with tungsten and/or iron (e.g., Silflex brand shielding material), each of the intermediate layers 18 may be a 2.0 inch thick layer of expanded polystyrene foam secured to the opposite sides of the interior layer by respective inner bonding layers 22, and each of the exterior layers 20 may be a piece of sheet metal respectively secured to the intermediate layers by respective outer bonding layers 23. The sheet metal may be coated, such as with paint. The exterior layers 20 may be twenty six gauge steel sheet metal, and typically the exterior layers will be ferromagnetic, as will be discussed in greater detail below. The exterior layers 20 may also be stainless steel sheet metal. The panel 10 may have an overall width of forty-six inches, and a height of eighty inches. Each of the above-mentioned dimensions may be approximate, and may vary by plus or minus any suitable percentage, such as five, ten, fifteen, twenty, twenty-five and/or any other suitable percentage. More generally, a wide variety of dimensions and/or other variations are within the scope of this disclosure. For example and as alluded to above, one or more of the layers 16, 18, 20, 22, 23, edge covers 13 and/or the frame 14 may be omitted, although the interior layer 16 will typically be included when it is desired to attenuate radiation (e.g., gamma radiation). As another example, radiation attenuation can be increased or decreased by changing the thickness of the interior layer 16 and/or the characteristics of the interior layer (e.g., changing the amount and/or type of the metal in the interior layer). Dimensions and other features of the panel 10 may vary depending upon any space constraints, cost constraints, amount of radiation attenuation desired, preferences and/or any other relevant factors.

Referring to FIG. 2, the layered structure 12 includes a top edge that may be referred to as a compound top edge 24 because preferably (e.g., optionally) the top edge of each of the layers 16, 18, 20 extends substantially all the way to and is substantially coextensive with the compound top edge. Similarly, typically the other edges of each of the layers 16, 18, 20 respectively extend substantially all the way to and are substantially coextensive with right, left and bottom compound edges 26, 28, 30 of the layered structure 12.

At least partially reiterating from above and in accordance with the first embodiment, the interior layer 16 in isolation may be a flexible sheet of material for restricting the propagation of radiation therethrough, and the edges of the interior layer respectively extend substantially all the way to and are substantially coextensive with the compound edges 24, 26, 28, 30 in an effort to maximize the breadth of the shielding provided by the interior layer. For securing the interior layer 16 in its broadly spread configuration, the interior layer 16 is secured between, and to both of, the intermediate layers 18 by the respective inner bonding layers 22, and the edges of the inner bonding layers respectively extend substantially all the way to and are substantially coextensive with the compound edges 24, 26, 28, 30. The intermediate layers 18 and/or the intermediate layers 18 in combination with the exterior layers 20 are typically more rigid than the interior layer 16. In one embodiment, the combinations of the intermediate and exterior layers 18, 20 (e.g., outer laminates comprising the intermediate and exterior layers), optionally further in combination with the inner bonding layers 22, are cooperative to support the intermediate layer in its broad configuration in which the edges of the intermediate layer respectively extend substantially all the way to and are substantially coextensive with the compound edges 24, 26, 28, 30 of the layered structure 12.

In one aspect of this disclosure, the layered structure 12 may be characterized as including a core or central laminate 32 (FIG. 3) that comprises the interior and intermediate layers 16, 18 with the respective inner bonding layers 22 therebetween. As one example of a method of forming the central laminate 32, a first of the intermediate layers 16 of the central laminate may be laid out horizontally, the upper surface first intermediate layer may be substantially completely covered with a first layer of adhesive material (for forming a first of the bonding layers 22), the interior layer 16 of the central laminate may be laid out over/onto the first layer of adhesive material in a substantially superposed relationship with the first intermediate layer, the second of the intermediate layers of the central laminate may be laid out horizontally, the upper surface second intermediate layer may be substantially completely covered with a second layer of adhesive material (for forming the second of the bonding layers), and the laminate of first intermediate layer, first bonding layer and interior layer may be laid out over/onto the second layer of adhesive material so that the interior layer and the first and second intermediate layers are all substantially superposed with one another, and the opposite sides of the interior layer are respectively in opposing face-to-face contact with the bonding layers. The exterior layers 20 may be mounted to the opposite sides of the central laminate 32 in a similar manner.

Alternatively, the central laminate 32 and/or the layered structure 12 may be formed in any other suitable manner. For example, in the central laminate 32, the bonding layers 22 may be omitted, so that the intermediate layers 18 are in direct opposing face-to-face contact with/are directly bonded to the interior layer 16. That is, the materials of the interior and intermediate layers 16, 18 may be selected so that the bonding layers 22 of adhesive material may be omitted. For example, the interior layer 16 may be formed and cured integrally with the intermediate layers 18 so that the intermediate layers are directly bonded to the interior layer without the bonding layers 22. For example, the intermediate layers 18 may be extruded onto the interior layer 16 and/or the intermediate and interior layers may be coextruded so that the intermediate layers are directly bonded to the interior layer without the bonding layers 22. Alternatively, any suitable materials (e.g., the bonding layers 22 of adhesive material) may be interposed between the interior and intermediate layers 16, 18. As another example, one or both of the intermediate layers 18 and bonding layers 22 may be omitted, in which case the interior layer 16 may be secured to one or more of the exterior layers 20, such as by way of one or more of the outer bonding layers 23.

Reiterating from above and as will be discussed in greater detail below, the layered structure 12 may be used without the edge covers 13/frame 14; therefore, the layered structure 12 in isolation may be referred to as the panel. When the layered structure 12 is used without the edge covers 13/frame 14, the exterior layers 20 may be secured to the central laminate 32 in any suitable manner, such as by way of the respective outer bonding layers 23. More specifically and in accordance with the first embodiment, the exterior layers 20 are respectively bonded to the intermediate layers 18, such as by way of the outer bonding layers 23, so that the exterior and intermediate layers are cooperative for together supporting the interior layer 16. Accordingly, the layered structure 12 as a whole may be a laminate. One or more of the layers 16, 18, 20 of the layered structure 12 may alternatively and/or additionally be secured together by way of one or more of the edge covers 13, the frame 14, one or more suitable mechanical fasteners and/or in any other suitable way.

In accordance with one acceptable method of the first embodiment, the panel 10 may be used as a portable shield for functioning as a barrier to radiation, such as alpha, beta and/or gamma radiation, as will be discussed in greater detail below. Accordingly, for purposes of durability and ease of any needed decontamination, the compound edges 24, 26, 28, 30 of the layered structure 12 may be fully and securely enclosed in the frame 14. The frame 14 may be characterized as being part of the panel 10, or the frame may be characterized as being a feature that may optionally be mounted to the panel/layered structure 12.

Referring to FIGS. 1 and 2, each of the edge covers 13 may be referred to as a part or member of the frame 14 (e.g., a frame member). In the first embodiment, the frame members or edge covers 13 are respectively mounted to the compound edges 24, 26, 28, 30 of the layered structure 12, such as for protecting the compound edges and/or holding the layers 16, 18, 20 together. As shown in FIG. 2, each edge cover 13 is a generally C or U-shaped structural channel member having a web 40 and flanges 42 extending from the web. For each edge cover 13, the flanges 42 are substantially parallel to one another and extend substantially perpendicularly away from opposite edges of a web 40, so that a groove 44 is defined by the edge cover. Each edge cover 13 may be constructed of metal, steel, or any other suitable material.

In the first embodiment, the grooves 44 of the edge covers 13 are respectively in receipt of marginal portions of the layered structure 12, so that, for each edge cover: the web 40 is in opposing face-to-face configuration with the respective compound edge 24, 26, 28, 30 of the layer structure; the front flange 42 of the edge cover is in opposing face-to-face relation with the respective marginal portion of the front exterior layer 20 of the layered structure; and the rear flange 42 of the edge cover is in opposing face-to-face relation with the respective marginal portion of the rear exterior layer 20 of the layered structure. In addition, adjacent ends of the edge covers 13 are mounted to one another, such as by welding, or through the use of any other suitable fastening techniques or fasteners.

More specifically, the ends of the edge covers 13 may be oblique, as shown in FIGS. 1 and 2, so that the adjacent ends of the edge covers are connected to one another at miter joints held together by welds or other suitable fastening techniques or fasteners. Adjacent ends of the edge covers 13 may be mounted to one another in any other suitable manner. For example, each end of the edge covers 13 may have a shape other than the oblique shape of a miter joint, and adjacent ends of the edge covers may be in an overlapping configuration with respect to one another.

The edge covers 13, and thus the frame 14, may be sized so that one or more of, such as each of, the opposing face-to-face configurations mentioned above may simultaneously be opposing face-to-face contacts, so that the margin of the layered structure 12 is securely held in the frame in an interference or friction fit. Not only may such a tight fit hold, or at least partially hold, the layered structure 12 together, it may also seek to minimize any open areas that may receive and harbor any contaminants to which the panel may be exposed. Alternatively, one or more of, such as each of, the opposing face-to-face configurations mentioned above may be a configuration in which the subject pair of surfaces are facing toward one another with one or more features positioned therebetween. For example, for each of the subject pair of surfaces that are facing toward one another, a bonding layer may be positioned therebetween, and any suitable adhesive materials may be used for the bonding layers. As a more specific example, each of the edge covers 13 may be formed of one or more strips of adhesive-backed tape, such as durable, strong tape or any other suitable structure. For example and not limitation, such a tape be an adhesive-backed strip of metal foil. Whereas the tape from which the edge covers 13 may be formed may be any suitable material, the tape may more specifically comprise a flexible strip that comprises polymeric material and metal for attenuating radiation, a flexible strip of silicone impregnated with metal, a flexible strip that comprises silicone impregnated with tungsten and/or iron, or more specifically the edge covers 13 may consist essentially of adhesive-backed silicone impregnated with tungsten and/or iron. As a more specific example, the edge covers 13 may be formed from, or at least partially formed from, Silflex brand shielding material, or any other suitable silicone tungsten/iron attenuation product, that is in the form of tape. Alternatively, one or more layers or edges of layered structure 12 may be secured together and/or covered with mechanical fasteners such as, but not limited to, clips. As indicated previously, this disclosure is not limited to the Silflex brand radiation shielding material available from MarShield or American Ceramic Technology, Inc. For example, any suitable source for the interior layer 16 may be used.

Figure 4:
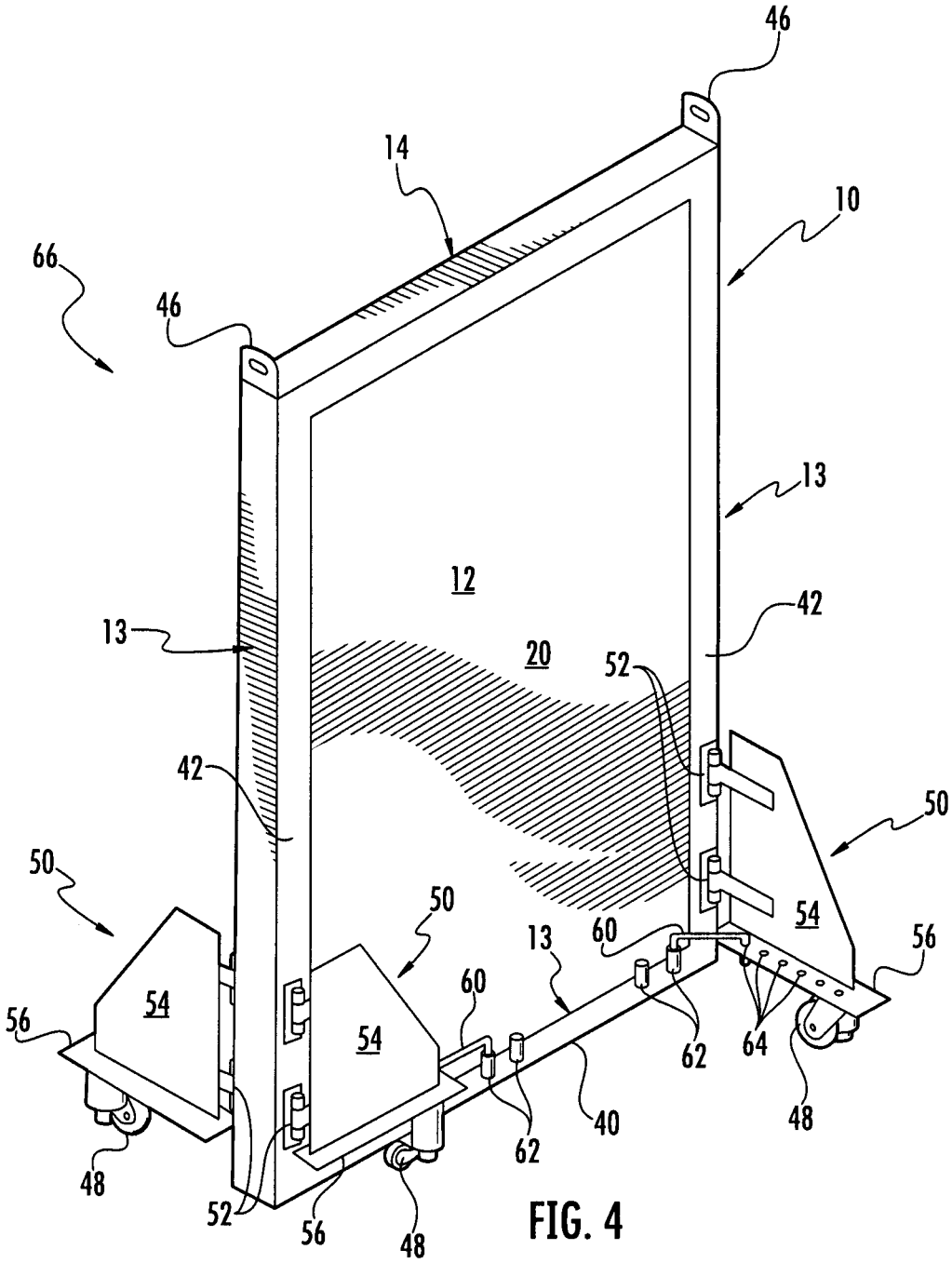
FIG. 4 is like FIG. 1, except for showing that the panel may include additional features, in accordance with the first embodiment of this disclosure.

In the first embodiment, the panel 10, with or without the frame 14, is strong enough to support at least its own weight without deforming substantially. As mentioned above, the panel 10 may be used as a portable barrier shield. Referring to FIG. 4 for example, the panel 10 may be equipped with one or more features, such as handles for being gripped, eyelets 46 for use in lifting the panel, wheels 48 for use in rolling the panel, and/or any other suitable features. For example, the eyelets 46 or any other suitable features for facilitating lifting of the panel, such as with a chain and overhead crane, may be attached to the upper portion of the frame 14, or in any other suitable location, such as by welding, or through the use of any other suitable fastening techniques or fasteners.

In the first embodiment, the wheels 48 support stabilizers, or legs 50, which in turn support the panel 10. The legs 50 are respectively mounted by hinges 52 to the front and rear flanges 42 of the right and left edge covers 13. Each leg 50 includes an upright plate 54 mounted to, and extending upwardly from, a base plate 56 of the leg. The 52 hinges are respectively connected between the upright plates 54 and the front and rear flanges 42 of the right and left edge covers 13. The wheels 48 are positioned beneath, and rotatably mounted to, the base plates 56. More specifically, the wheels 48 may be components of conventional leveling castors that are mounted to the base plates 56. In additional to including one or more of the wheels 48 for rolling across a supporting surface, such as a floor, each leveling castor may include a vertically adjustable member for engaging the floor. The vertically adjustable members of the leveling castors may be operated in a concerted manner that seeks to cause each of the vertically adjustable members to simultaneously be in contact with the floor, which seeks to avoid wobbling of the panel relative to the floor. Alternatively, the wheels 48/castors may be omitted and the lower surfaces of the base plates 56 and optionally also the web 40 of the bottom edge cover 13 may engage the floor.

The hinges 52 allow the legs 50 to be pivoted between a wide range of configurations, such as between an extended configuration for relatively greater stabilization, and a retracted configuration for relatively less stabilization/storage. A fixing or locking mechanism may be associated with each of the legs 50 for releasably securing the legs 50 relative to the panel 10 in the desired configuration. In FIG. 4 for example, the front right and left legs 50 are shown locked in extended and retracted configurations, respectively. The locking mechanism associated with each pivotable leg 50 may include a bar 60 with downwardly bent opposite ends for being removably received in receptacles 62 of the frame 14 and receptacles 64 of the legs 50. For example, the frame's receptacles 62 may be in the form of pieces of pipe mounted (e.g., welded) to the flanges 42 of the bottom edge cover 13, and the leg's receptacles 50 may be in the form holes in the base plates 56. Alternatively, any other suitable features may be used for releasably securing the pivotable legs 50 relative to the panel 10, or the legs 50 may be permanently fixedly mounted (i.e., nonpivotably mounted) to the panel. The panel 10 together with the frame 14 and other features mounted thereto may be referred to as a panel assembly 66.

Each of the exterior components of the panel 10 or panel assembly 66, or at least the exterior layers 20, may be made of metal, or more specifically steel, for purposes of cleanliness and durability. In addition, each of the exterior components of the panel 10 or panel assembly 66 may be made of a ferromagnetic metal, so that the ability of the panel 10 to shield radiation may be supplemented by magnetically attaching one or more radiation shielding blankets (not shown), or the like, to the exterior of the panel. For example, magnets may be built into or otherwise mounted to the radiation shielding blankets or other accessories, so that the blankets or other accessories can be attached to one or more exterior surfaces of the panel 10, such as the front or rear exterior layers 20, by way of the magnets. Alternatively, one or more of the exterior components of the panel 10 or panel assembly 66 may be made of a material other than metal, such as a material having a strong, substantially smooth and non-porous surface that is both durable and easy to clean (e.g., decontaminate, if exposed to radioactive contamination). For example, one or more of the exterior components of the panel 10 or panel assembly 66 may be made of suitable polymeric materials.

Figure 5:
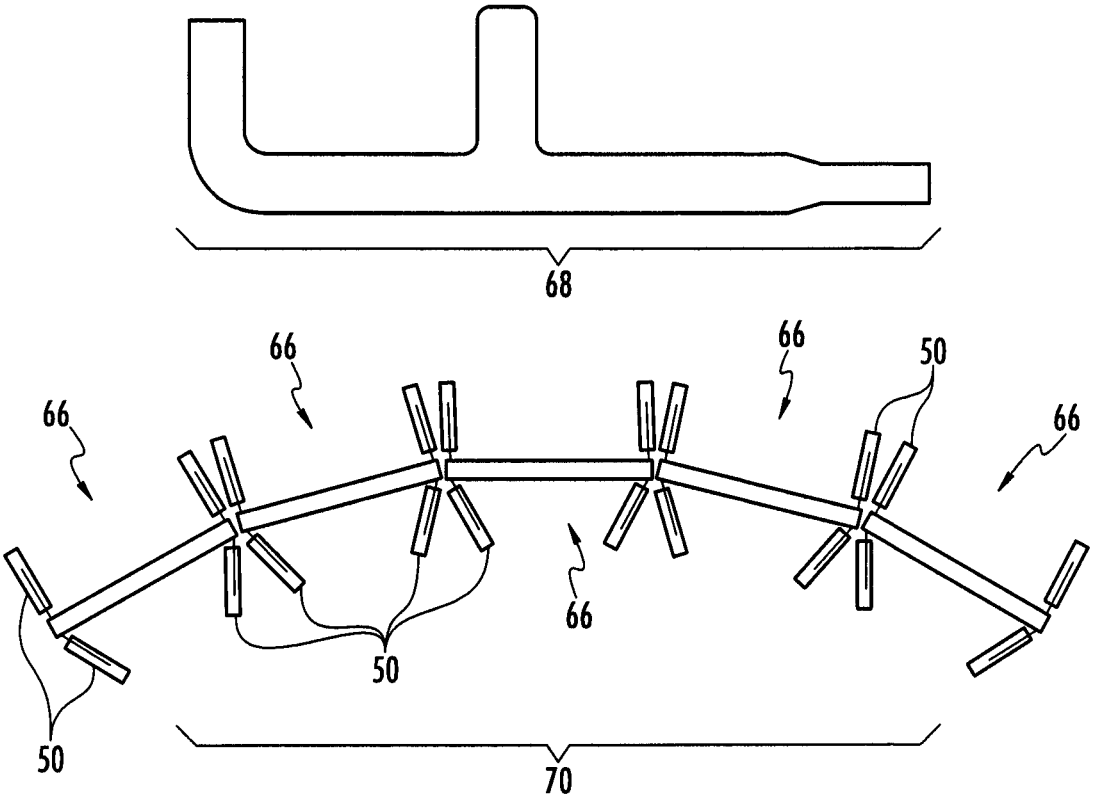
FIG. 5 is a top plan view of a series of the panels or panel assemblies positioned between a shielded area and radiological hot zone from which radiation is being emitted, in accordance the first embodiment.

The layered structure 12, a portion of the layered structure 12, the panel 10, the and the panel assembly 66 may each be put to a variety of uses, such as, but not limited to, inhibiting the propagation of radiation. For example, FIG. 5 illustrates a series of panel assemblies 66 arranged edge-to-edge, and positioned adjacent to a radiological hot zone 68 so that the series of panel assemblies 66 define a shielded area that is very generally designated by the numeral 70. The radiological hot zone 68 is shown in FIG. 5, for example and not limitation, as being in the form of a section of piping that may be part of a nuclear reactor coolant system, and may be emitting alpha, beta and/or gamma radiation. The series of panel assemblies 66 is positioned between the shielded area 70 and radiological hot zone 68. For example and assuming no other sources of radiation, humans would receive less of a radiation dose per time in the shielded area 70 as compared to the radiological hot zone 68. Therefore, when possible, a computer work station or other support services will be arranged in the shielded area 70 rather than the radiological hot zone 68. When manual work must be done in the radiological hot zone 68, the humans doing the manual work may do preparatory work, take breaks or otherwise rest, or the like, in the shielded area 70.

Each of the layered structure 12, a portion of the layered structure 12, panel 10, and panel assembly 66 may be used as a barrier, or as part of a barrier, for attenuating radiation emitted from a wide variety of sources. For example, the panel assembly 66 may be moved, such as using the eyelets 46 and/or wheels 48, between a variety of radiological hot zones 68 in one or more nuclear power plants or in any other facilities where radiological hot zones may be present. Alternatively or in addition, each of the layered structure 12, a portion of the layered structure 12, and/or the panel 10 may be used as a structural panel or a structural insulated panel.

Directional references (e.g., top, upper, lower, bottom, front, back, rear, left, right, top, bottom, above, below, crosswise and the like) may have been used in this disclosure for ease of understanding and not for the purpose of limiting the scope of this disclosure. Accordingly, while the present disclosure has generally been provided in terms of certain illustrated configurations, directional references related thereto are provided only for example.

The above examples are in no way intended to limit the scope of the present invention. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A panel for attenuating radiation, the panel comprising: a layered structure comprising a laminate secured between layers of sheet metal, wherein said laminate comprises a flexible layer comprising polymeric material and metal, wherein said metal is for attenuating radiation, and a layer of foam secured to said layer of polymeric material containing metal, wherein said flexible layer is more flexible than said layer of foam.

2. The panel according to claim 1, wherein said layers of metal comprises a sheet of steel that is bonded to said layer of foam, so that said sheet of steel and said layer of foam are cooperative for at least partially supporting said layer of silicone containing metal.

3. The panel according to claim 1, wherein said polymeric material comprises silicone and said metal comprises at least one metal selected from the group consisting of tungsten and iron, and said silicone at least partially contains said metal.

4. The panel according to claim 3, wherein said metal is impregnated in said silicone.

5. The panel according to claim 1, wherein:

said layer of foam is a first layer of foam;

said laminate further comprises a second layer of foam;

said flexible layer includes opposite first and second sides;

said first side of said flexible layer is bonded to said first layer of foam; and said second side of said flexible layer is bonded to said second layer of foam.

6. The panel according to claim 5, wherein:

said layers of metal comprises first and second sheets of steel;

said first sheet of steel is bonded to said first layer of foam, so that said first sheet of steel and said first layer of foam are cooperative for at least partially supporting said layer of silicone containing metal; and said second sheet of steel is bonded to said second layer of foam, so that said second sheet of steel and said second layer of foam are cooperative for at least partially supporting said layer of silicone containing metal.

7. The panel according to claim 1, comprising a frame mounted to said layered structure for securing said layered structure, wherein:

said layered structure comprises a top compound edge, a bottom compound edge, and side compound edges;

said frame includes frame members, each of said frame members defines an elongate groove, and said grooves of said frame members are respectively in receipt of said top, bottom, and side compound edges of said layered structure; and said frame members are respectively secured to one another, so that said frame members cooperate to extend around said layered structure.

8. The panel according to claim 7, further comprising:

a plurality of legs pivotably mounted to said frame for supporting said frame and said layered structure; and a plurality of wheels respectively mounted to said legs for supporting said legs, said frame and said layered structure, wherein said wheels are adapted for allowing the panel to be rolled across a surface.

* * * * *